US005685665A

United States Patent [19]

Lembo

[11] Patent Number: 5,685,665

[45] Date of Patent: Nov. 11, 1997

[54] ROADWAY BARRIER AND METHOD OF INSTALLATION

[76] Inventor: M. Carl Lembo, 10119 Caddo Trl., Magnolia, Tex. 77355

[21] Appl. No.: 647,349

[22] Filed: May 9, 1996

[51] Int. Cl.[6] ..... E01F 15/04

[52] U.S. Cl. ..... 404/6; 256/13.1

[58] Field of Search ..... 404/6, 9; 256/1, 256/13.1

[56] References Cited

U.S. PATENT DOCUMENTS

| | | | |
|---|---|---|---|
| 2,509,274 | 5/1950 | Nugey . | |
| 3,082,994 | 3/1963 | Rasmussen . | |
| 3,678,815 | 7/1972 | Younker | 256/13.1 X |
| 4,111,401 | 9/1978 | Pickett . | |
| 4,433,831 | 2/1984 | Bunger . | |
| 4,681,302 | 7/1987 | Thompson . | |
| 4,806,044 | 2/1989 | Duckett . | |
| 4,815,889 | 3/1989 | Duckett . | |
| 4,828,425 | 5/1989 | Duckett . | |
| 4,954,009 | 9/1990 | Kellison . | |
| 5,046,884 | 9/1991 | Girotti . | |
| 5,118,216 | 6/1992 | Smith . | |
| 5,286,136 | 2/1994 | Mandish et al. . | |
| 5,292,467 | 3/1994 | Mandish et al. . | |
| 5,387,049 | 2/1995 | Duckett . | |
| 5,443,324 | 8/1995 | Sullivan . | |

FOREIGN PATENT DOCUMENTS

| | | |
|---|---|---|
| 4320720A1 | 12/1994 | Germany . |
| 2237313 | 5/1991 | United Kingdom . |

*Primary Examiner*—James Lisehora

[57] ABSTRACT

A roadway barrier (10) secured to the upper surface of a roadway (12) is formed of a plurality of half sections (20). The half sections (20) form a plurality of modules (18A–18E) positioned in two back to back columns (14A–14B) on the roadway (12). The half sections (20) and associated modules (18A–18C) in one column (14A) are staggered with respect to the half sections (20) and associated modules (18D–18E) in the other column (14B). A cable (44) for each module extends through aligned axial passages (36) in the associated half sections (20) to connect the half sections together. Bolts (66) are received within aligned transverse passages (32) in back to back half sections (20) to connect the two columns (14A, 14B) to each other. Shock absorbing means (60, 68) are mounted between cables (44), bolts (66) and the connected half sections (20) to permit a cushioned movement of barrier wall (10) upon impact of a moving vehicle.

27 Claims, 3 Drawing Sheets

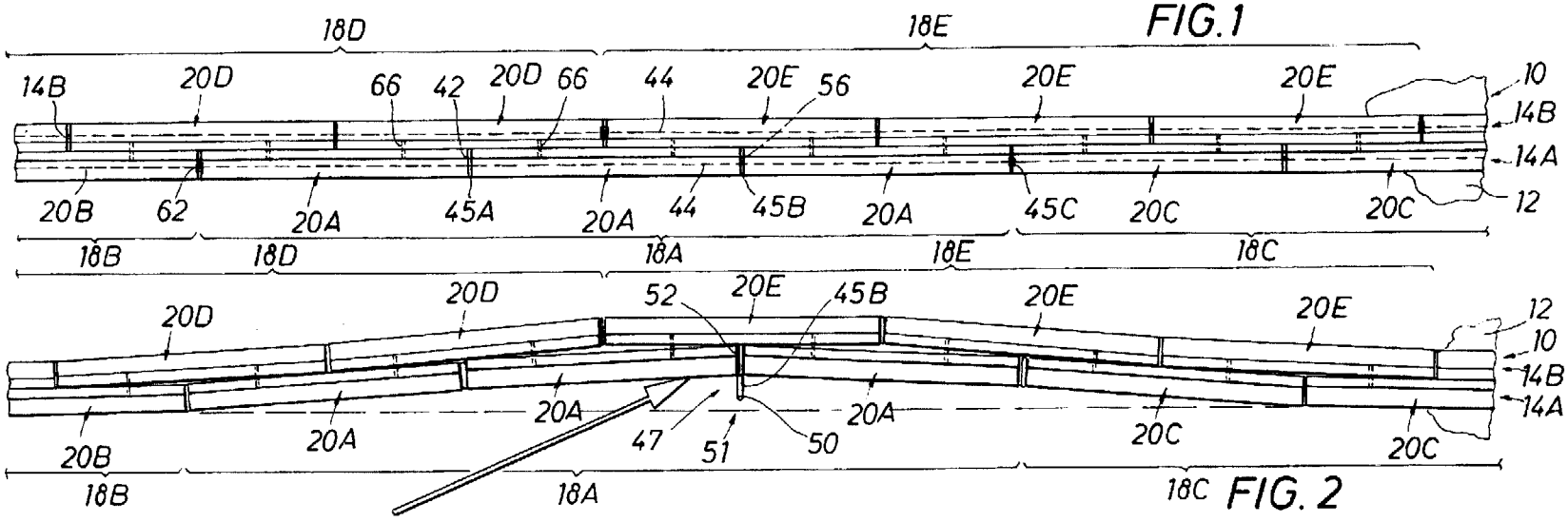
FIG. 1
FIG. 2
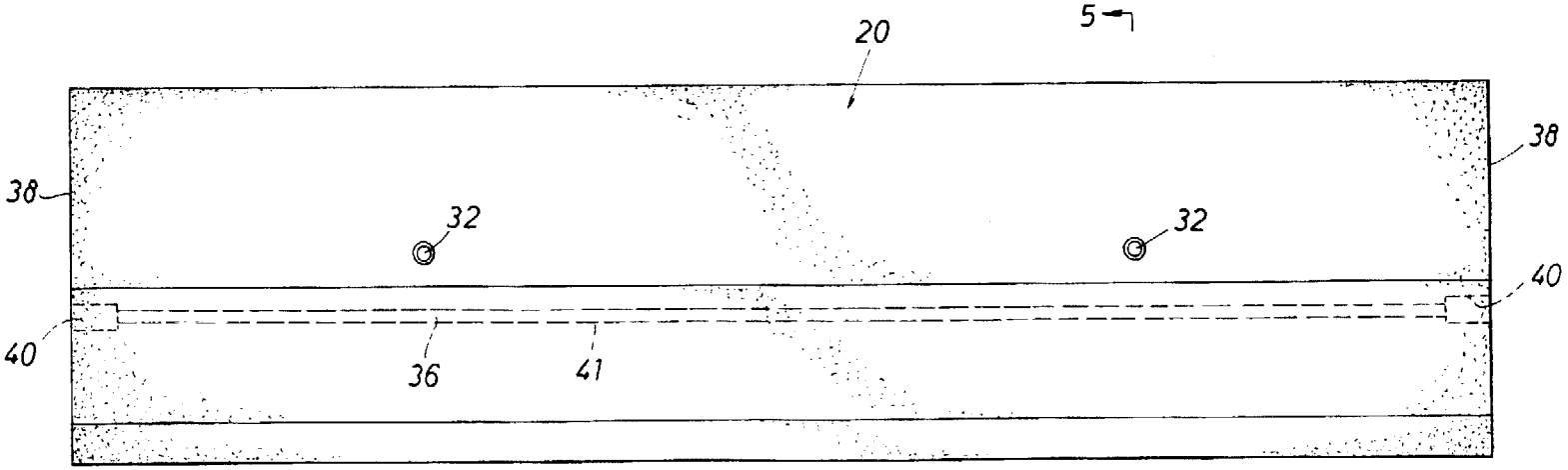
FIG. 4

ROADWAY BARRIER AND METHOD OF INSTALLATION

BACKGROUND OF THE INVENTION

1. Field of the Invention

This invention relates generally to a roadway barrier and a method for its installation, and in particular to such a roadway barrier or wall and installation method for absorbing moving vehicle impact energy against the barrier.

2. Description of Prior Art

Many roadway barriers in use today are rigid structures which absorb little if any of the energy of a vehicle crashing against it. The prior art has sought systems for absorbing high impact energy from moving vehicles. For example, U.S. Pat. No. 4,806,044 dated Feb. 21, 1989 shows a lane barrier system in which a plurality of adjacent modules are connected to each other about a common vertical pivot to permit each adjacent pair of modules to elongate or contract for assuming a composite length different from a normal length when an impact load is imposed, and to return to the normal length under a biasing force. Each module of the '044 patent includes a pair of transversely aligned half sections transversely secured to each other and has longitudinally extending rigid tie bars which are encased in the concrete casting for the module. The biasing force which is effective in absorbing impact loads comprises elastomeric pads at the common vertical pivot which are placed in compression in response to elongation or contraction of the module. The modules are not arranged in a staggered relation to each other and are not anchored to the roadway.

U.S. Pat. No. 4,815,889 dated Mar. 28, 1989 discloses a system which is generally similar to that of U.S. Pat. No. 4,806,044, but utilizes a different shock absorber structure. A fluid cylinder and piston combination is used for each module to absorb impact loads against the modules which are pivotally connected to each other. Thus, a costly and relatively complex shock absorber is provided for reach module.

U.S. Pat. No. 5,286,136 dated Feb. 15, 1994 discloses an energy absorbing roadway barrier for dissipating kinetic energy upon impact by a moving vehicle. The energy absorbing barrier is formed of a central core of reinforced high density concrete surrounded by a cover portion formed of a lightweight energy absorbing concrete having lightweight polymer materials therein which are resilient in nature. Materials such as recycled rubber or polystyrene pieces are suggested. The outer lightweight concrete material is designed to be an energy absorbing concrete for dissipating kinetic energy upon impact with a moving vehicle.

U.S. Pat. No. 5,387,049 dated Feb. 7, 1995 is also directed to a roadway barrier system for absorbing high impact loads from a moving vehicle. The barrier system is formed by connecting a plurality of modules together in tandem by one or more cables which distribute impact loads imposed on the system to several modules. The modules may be filled with water to provide a shock-absorbing medium. However, no means are provided for return of the modules to their original position after impact.

Most roadway barriers in use today are heavy columns of concrete which are expensive to manufacture, and transport and install due to their size. Furthermore, most barrier systems in use today require maintenance costs to realign such barriers, because they move in response to thermal expansion and roadway vibration forces in addition to vehicle impacts.

IDENTIFICATION OF OBJECTS OF THE INVENTION

A principal object of the invention is to provide a roadway barrier which flexes in the direction of the impact of a crashing vehicle to absorb partially the energy from the impact with the barrier returning to its original unrestrained position after impact.

Another object of the invention is to provide a roadway barrier of two lightweight concrete half sections which are about one-third less than the weight of whole barrier sections of commonly used barriers, thereby reducing handling and installation costs of a highway barrier system.

Another object of the invention is to provide a highway barrier system which remains in place and resists movement when at rest from thermal expansion forces and roadway vibrations, thereby decreasing highway maintenance costs.

SUMMARY OF THE INVENTION

The present invention is directed to a roadway barrier and a method of its installation, and particularly to a roadway barrier and installation method for absorbing moving vehicle impact energy against the barrier. The barrier of this invention moves slightly in the direction of impact, thus absorbing much of the energy of the impact, thereby permitting a crashing vehicle to continue in the direction in which it was traveling along the barrier and minimizing any deflection or bouncing of the vehicle into other lanes of traffic. Such an energy absorbing roadway barrier enhances the ability of the driver of the vehicle to retain control of the vehicle thereby decreasing the probability of a more serious accident if a vehicle bounces into other lanes of roadway traffic.

The barrier includes a plurality of modules positioned in two horizontal sections or columns in back to back and staggered relation to each other. Each module includes a plurality of half-sections placed in end to end relation having aligned internal longitudinal passages through the half sections in which a connecting cable is received and secured at opposed remote ends of the module. The cable may be tensioned a predetermined amount at the ends of each module.

Each module includes an anchor structure secured to the roadway at predetermined intervals, such as forty (40) to eighty (80) feet. The anchor structure includes an anchor member connected at an upper end to the cable and mounted for pivotal movement at its lower end about a horizontal axis to permit a limited transverse movement of the module. The flexible cable has limited elasticity and permits limited transverse and longitudinal movements of the module upon impact of a crashing vehicle while providing for the return of the module to its original position after partial absorption of the impact energy. Springs may be connected to the cable to assist in the absorption of impact energy and in the return of the module.

Each module of back to back opposed half sections is positioned such that opposed modules lap each other and the half sections of one module lap the half sections of an opposed module. It is desirable that one module lap an adjacent module for one half the length of the adjacent module. Likewise, it is desirable that one half section lap an adjacent half section for one half the length of the adjacent half section. As a result, the joints between the modules in one column are staggered with respect to the joints of the modules of the opposed column. Each of the half sections for each module has a pair of transverse passages which are aligned transversely with transverse passages in staggered half sections of the opposed column. Bolts are positioned within the aligned transverse passages for back to back opposed connection of the two columns to each other. Springs are connected to the bolts to enhance absorbing of impact energy upon movement of the modules resulting from vehicle impacts. Such springs also assist the return of the modules to their original position after impact.

The half sections forming each module are formed of a reinforced lightweight cast concrete with the longitudinal and transverse passages being provided during molding of the half sections. The joints between adjacent half sections in each module have an expansion gasket therebetween. The expansion gasket at the joints include a cutout portion to receive an anchor member for anchoring the cable to the roadway. The cable connects a plurality of half sections together for forming the module. The utilization of half sections provides relatively lightweight sections which can be easily transported and positioned on the roadway.

The roadway barrier system of this invention formed of a plurality of separate modules provides a continuous flexible structure that is capable of moving generally in the direction of a crashing vehicle and returning to its original position after impact. Adjacent half sections move primarily in a transverse direction upon the exertion of impact loads against adjacent modules with only a relatively small longitudinal movement in the direction of an impact. The half sections return substantially to their original location after partially absorbing impact energy.

Other features and advantages of the invention will become more apparent after referring to the following specification and drawings.

BRIEF DESCRIPTION OF THE DRAWINGS

FIG. 1 is a schematic view of the roadway barrier of the present invention shown in a normal rest position on a roadway with lapped modules of back to back positioned horizontal columns forming the barrier;

FIG. 2 is a schematic view of the barrier of FIG. 1 illustrating the position of the barrier after impact of a moving vehicle and showing the cushioned movement of lapped modules forming the barrier;

FIG. 4 is an enlarged front elevation of a half section;

DESCRIPTION OF THE INVENTION

Figure 3:
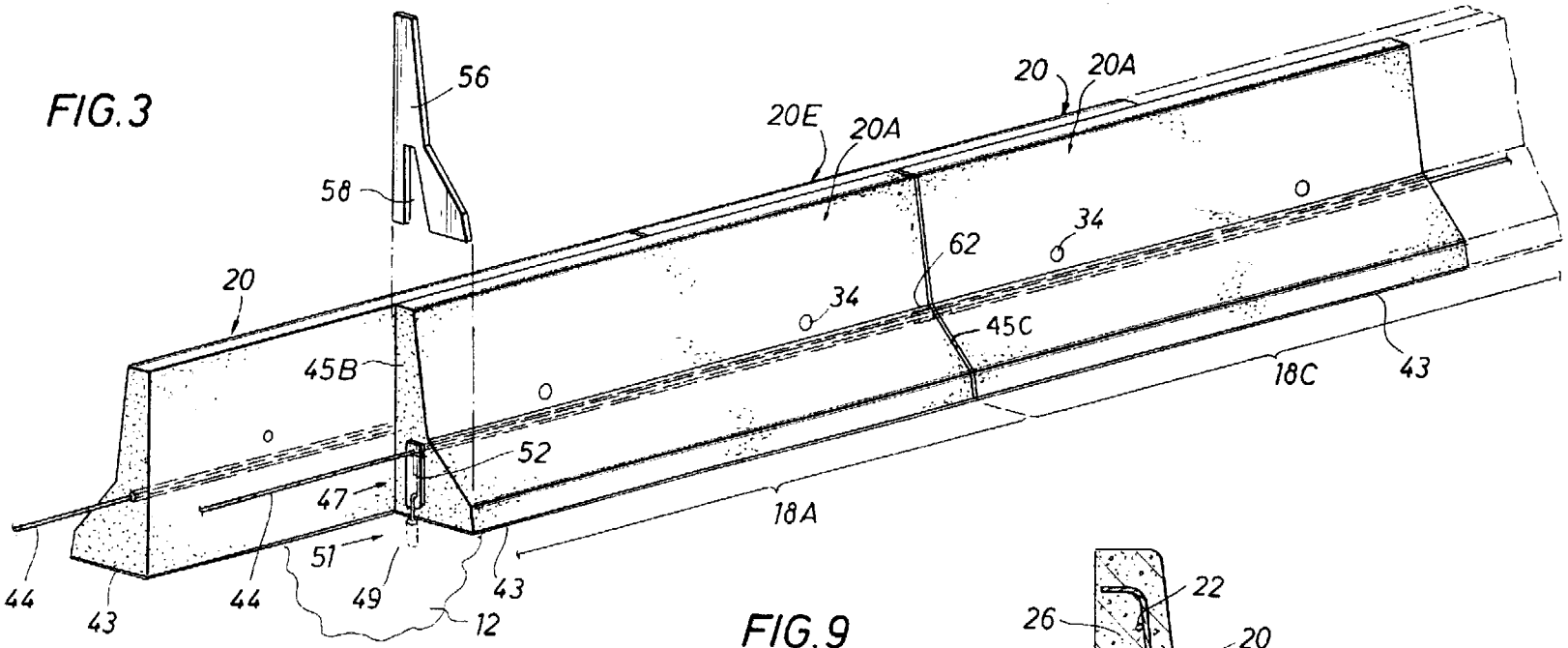
FIG. 3 is a perspective view of a portion of the barrier shown in FIGS. 1 and 2 showing a portion of back to back modules connected to each other, with half sections of a module in one column being staggered relative to half sections of a module in the other column.

Referring now particularly to FIGS. 1 and 2, the roadway barrier system of the present invention is shown schematically in top view. FIG. 1 shows a roadway barrier generally indicated at 10 and secured to the upper surface of a roadway 12. Barrier 10 is formed in two horizontal columns or lines 14A and 14B placed in back to back relation to each other. Columns 14A and 14B include a plurality of modules or units placed end to end. In FIGS. 1 and 2, column 14A is illustrated by module 18A and partial sections of tandem modules 18B and 18C. Modules 18E and 18D are illustrated for column 14B. Each of the illustrated modules 18A–18E includes a plurality of coupled half sections 20. Module 18A as shown in FIGS. 1 and 2 includes three half sections 20A. Module 18C includes end to end positioned half sections 20C and so on. Any desired number of half sections 20 may be provided in a module with the number of half sections dependent primarily on the length of each half section 20. Each half section 20 is of a predetermined length, preferably of ten (10), twenty (20), or thirty (30) feet. For best results, the length of each module 18A–18E is between about forty (40) and eighty (80) feet. Two (2) to five (5) half sections 20 are preferably employed in a module. In order to create a barrier as illustrated in FIGS. 1 and 2, each half section 20 is preferably manufactured of a standard length, and consequently each module 18 is of a standard length. Of course, many modules are connected end to end to form a roadway barrier.

The two horizontal columns 14A, 14B illustrated by modules 18A–18E are anchored to roadway 12 and are connected transversely to each other to permit lateral movement of half sections 20 and a limited longitudinal movement as shown in FIG. 2 upon impact of a moving vehicle against barrier 10. The movement of half sections 20 from a normal rest position is resisted by energy absorbing means and upon absorption of the impact by energy dissipation, modules 18A–18E and associated half sections 20 return automatically to their original rest position shown in FIG. 1 as explained below. Thus, barrier 10 moves slightly in the direction of the impact to partially absorb energy of the impact thereby enhancing the probability of the vehicle operator regaining control of a crashing vehicle thereby reducing the probability that the vehicle will bounce into other lanes of a multi-lane roadway, for example.

Figure 5:
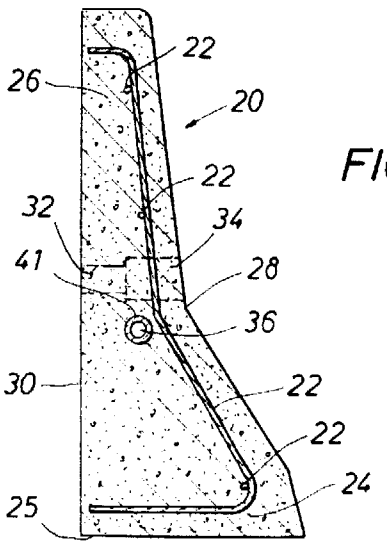
FIG. 5 is an enlarged cross section of the half section shown in FIG. 4 taken generally along line 5—5 of FIG. 4.

Referring now to FIG. 5, a half section 20 is illustrated as formed of precast lightweight concrete reinforced with metal reinforcing bars 22. In some instances, it may be desirable to utilize welded wire fabric instead of reinforcing bars. Each half section 20 has a base 24 with a horizontal bottom surface 25 and converges toward an upper portion 26 to define a sloping front surface 28. A rear planar surface 30 of half section 20 extends in a vertical direction when half section 20 is mounted on roadway 12. When two half sections are placed back to back to each other, the cross sectional profile of the composite structure assumes the shape of the New Jersey barrier commonly used on U.S. roadway. A pair of transverse horizontal passages 32 are cast in each half section 20 (see FIG. 7 also). Each passage 32 has a large diameter outer end portion 34. A single longitudinal passage 36 is cast in each half section 20 and extends between opposed ends 38 of half section 20 (see FIG. 4 also). Passage 36 has an enlarged diameter end portion 40 adjacent each end 38 of half section 20 (see FIG. 8). Passage 36 is defined by a tubular sleeve 41 of polyvinyl chloride (PVC) which is inserted during casting of half section 20.

Figure 7:
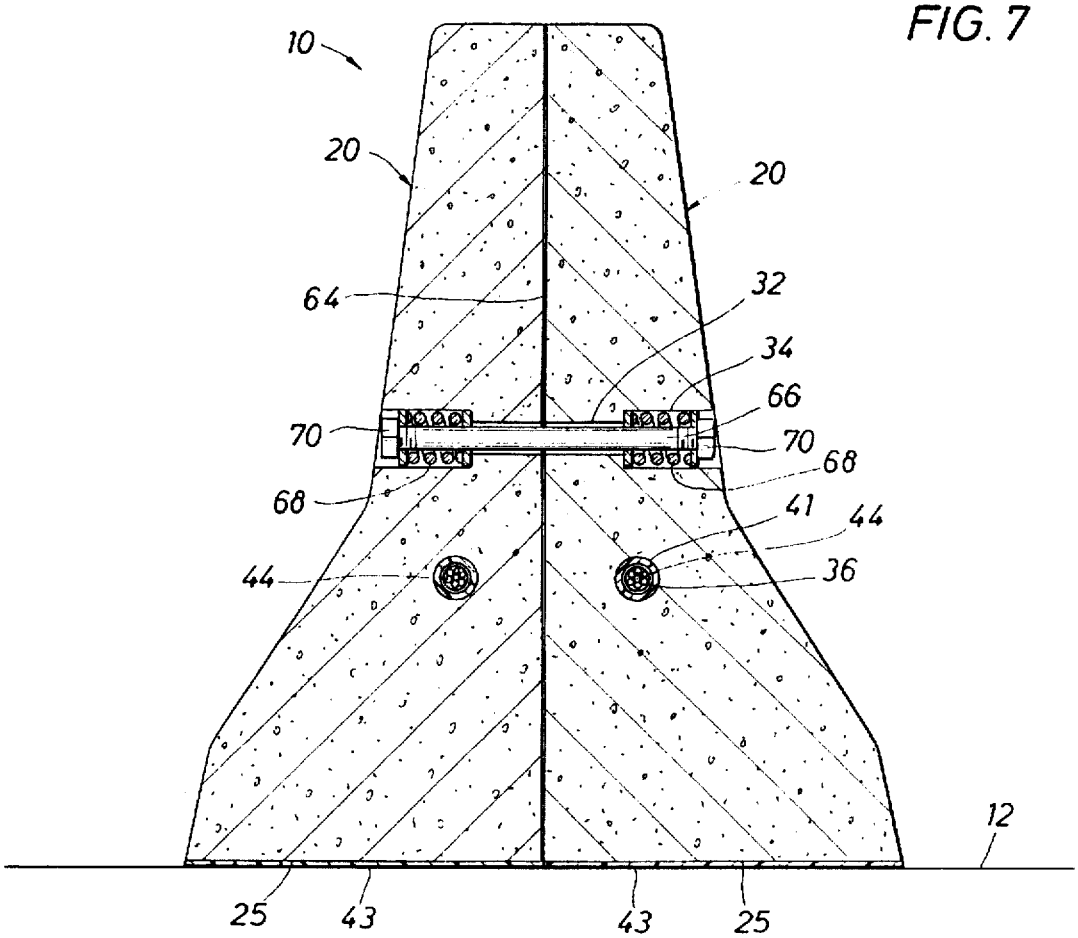
FIG. 7 is an enlarged cross section of the modules shown in FIG. 3 which illustrates the transverse connection for the modules.

After casting half section 20, as shown particularly in FIG. 7, a bearing or wear pad 43 formed of an elastomeric material, such as ultra high molecular weight polyethylene, is secured by a suitable epoxy adhesive to bottom surface 25 of each half section 20 for contact with roadway 12 for enhancing sliding movement of half section 20 along roadway 12 where the barrier 10 is impacted by a crashing vehicle.

Figure 6:
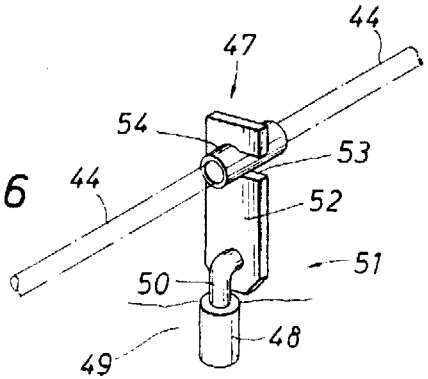
FIG. 6 is an enlarged view of a cable anchor of FIG. 3 for anchoring a module to the roadway with the anchor shown removed from the roadway.

Modules such as 18A–18E are each formed in a similar manner. For purposes of illustration, only module 18A is described in detail. Module 18A includes three half sections 20A positioned in end to end relation on roadway 12. Two or four half sections may be provided, but an odd number of half sections is preferred. Joints 45A, 45B are internal joints formed in module 18A between half sections 20A. An expansion gasket 42 preferably formed of neoprene or reclaimed rubber is positioned between one internal joint such as 45A. An expansion gasket 56 as shown in FIG. 3 is positioned in one of the internal joints, such as 45B. A steel tension 44 is positioned within aligned longitudinal passages 36 and secures half sections 20A together in a tensioned relation as described below. Cable 44 is anchored to roadway 12 by a cable anchor generally indicated at 51 and positioned at joint 45B for example as shown in FIGS. 3 and 6. Cable anchor 51 has a lower fixed anchor base 48 inserted into the base of roadway 12. Base 48 is normally secured to a concrete slab 49 in roadway 12. In the event roadway 12 is formed of asphalt, a separate concrete pier is normally provided in the roadway at the ends of the concrete barrier sections to secure base 48. An upwardly extending J-bolt 50 is secured to base 48. A cable tie-down arm 52 is pivotally mounted to fixed J-bolt 50 and has a side opening 53. Cable 44 is received within a wear sleeve 54 which is secured to arm 52 within opening 53. Arm 52 is free to pivot about J-bolt 50 thereby permitting transverse movement of adjacent half sections 20. Expansion gasket 56 has a cut out portion 58 to receive arm 52 of anchor 51 therein to permit relative pivotal movement. Gaskets 42 and 56 also provide cushioning for the adjacent half section 20.

Figure 8:
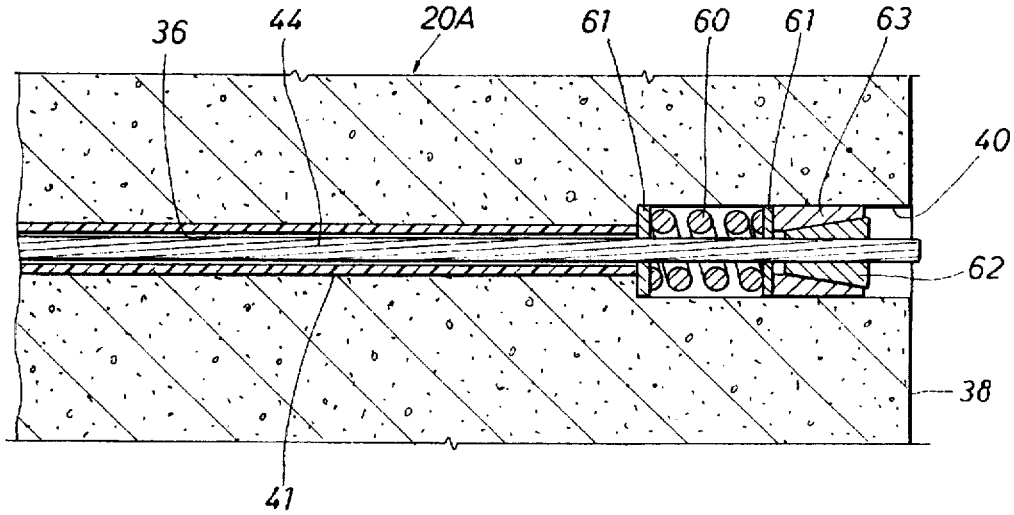
FIG. 8 is an enlarged view of an arrangement for securing an end of a cable which connects adjacent half sections to form a module.

To secure half sections 20A of a module 18A together (for example) in tensioned relation, cable 44 extends continuously from the end of an end half section 20A of module 18A to the end of another end half section 20A end. The ends of cable 44 are secured in a similar manner to the ends of such ends of half sections. For the purpose of illustration, FIG. 8 shows the securement of cable 22 for half section 20A extending within enlarged diameter end portion 40 of passage 36. A compression spring 60 is mounted between enlarged diameter portion 40. A cable chuck 62 is mounted within tapered sleeve 63 within enlarged diameter end portion 40 and is secured about cable 44 to tension cable 44 a predetermined amount. Module 18A of horizontal column in this way is mounted on roadway 12.

The adjacent modules 18D and 18E in column 14B are next positioned in back to back relation to module 18A. A longitudinally extending gasket 64 (see FIG. 7) is mounted on the planar back surface of module 18A formed by surfaces 30 of half sections 20. Then, half sections 20D of module 18D are positioned in lapped back to back relation to half sections 20 of module 18A with transverse passages 32 in adjacent half sections 20 aligned transversely. Tie bolts 66 are inserted within aligned transverse passages 32, and a compression spring 68 is received within each enlarged diameter end portion 34 for fitting about bolt 66. A nut 70 on one end of bolt 66 adjusts the compression of springs 68.

Any desired number of modules may be provided dependent primarily on the desired length of barrier 10. The number of cable anchor structures 51 is predetermined and may be provided at every joint in some instances where long length half sections are provided, such as half sections twenty (20) feet in length. The amount of transverse movement of the modules is controlled primarily by the length of anchor arm 52 and the tension springs for cable 44. The transverse movement of the modules will vary from a maximum of about six (6) to eight (8) inches.

Providing half sections of a relatively short length and formed of a lightweight high-strength reinforced concrete results in a relatively lightweight half section which may be easily transported to an installation site. Such a light weight half section may be easily unloaded and positioned on a roadway for forming of the separate modules and the roadway barrier.

As a specific example of a half section suitable for a roadway barrier wall, a half section is formed of reinforced concrete having a compressive strength of at least 5000 psi and a tensile strength of about 1000–2500 psi. A steel twisted cable is provided of ⅜ inch in diameter and having a tensile strength of 20,000 lbs. A half section having a length of twenty (20) feet weighs about 4000 pounds.

While flexible metal cables 36 having a limited elasticity are preferred for connecting a plurality of half sections 20 together for each module, it is to be understood that other types of connecting means may be utilized for extending through the aligned openings in the half sections. While the half sections in the separate columns have been shown as lapping for one half the length of the half sections, it may be desirable under certain conditions that the half sections in the separate columns lap each other in different proportions. Half sections 20 as indicated previously may be of various lengths, preferably in ten (10), twenty (20), or thirty (30) foot lengths. When utilized for a curve in a roadway, it may be desirable to provide short length half sections, such as ten (10) feet or shorter depending on the radius of curvature of the roadway.

Figure 9:
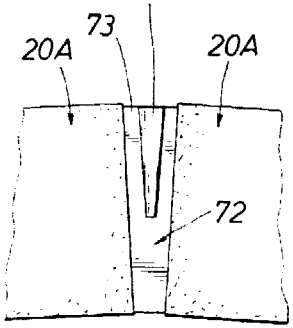
FIG. 9 is a top plan of a gasket positioned between a pair of adjacent half sections on a curved roadway section.

Referring particularly to FIG. 9, an expansion gasket generally indicated at 72 is illustrated for a curved roadway section between adjacent half sections 20A. Gasket 72 preferably formed of neoprene or reclaimed rubber is slit along one side 73 to receive a hard rubber wedge-shaped insert 74 to provide an increased thickness for gasket 72 at side 73. Wedge-shaped insert 74 is secured to gasket 72 by a suitable epoxy adhesive. Gasket 72 is preferably compressed slightly between half sections 20.

Normally, the lateral movement of the barrier wall 10 would not be greater than about six (6) to eight (8) inches, because it is believed that adequate energy dissipation and absorption of impact is obtained by relatively small lateral movements of barrier wall 10. Barrier wall 10 moves longitudinally in the direction of impact a few inches, such as 2 to 4 inches, for example. As indicated above, the amount of movement of the modules may be controlled primarily by the length of anchor arm 52, the length of compression springs 60 for cable 44, and the elasticity of cable 44.

While preferred embodiments of the present invention have been illustrated in detail, it is apparent that modifications and adaptations of the preferred embodiments will occur to those skilled in the art. It is to be expressly understood that such modifications and adaptations are in the spirit and scope of the present invention as set forth in the following claims:

What is claimed is:

1. A roadway barrier comprising:

a pair of longitudinally extending columns in back to back contact relation with each other to form said barrier, each column including a plurality of half sections in end to end relation and having a width and a length;

each of said half sections having an axial passage extending between opposed ends of each half section and aligned axially with similar passages in adjacent half sections; and a longitudinal connecting member received within aligned passages of at least two adjacent half sections in each of said columns to connect said adjacent half sections together to permit lateral movement of said half sections upon vehicle impact.

2. A roadway barrier of claim 1 further comprising:

tensioning means for tensioning said connecting member against said adjacent half sections.

3. A roadway barrier of claim 1 wherein:

said longitudinal connecting member is a cable.

4. A roadway barrier of claim 1 wherein:

said half sections in one column have transverse openings aligned with transverse openings in adjacent half sections of the other column, and transverse connecting members are secured within aligned transverse openings of the pair of columns to connect said columns together.

5. A roadway barrier of claim 1 further comprising:

anchor means for anchoring said longitudinal connecting member to a roadway.

6. A roadway barrier of claim 5 wherein:

a joint is provided between adjacent ends of said half sections; and said anchor means includes an anchor member secured to the roadway at selected joints and connected to said connecting member.

7. A roadway barrier of claim 6 wherein:

said connecting member is a cable, and said anchor member is coupled to said cable for transverse movement with said cable.

8. A roadway barrier of claim 7 wherein:

said anchor member has a lower end which is secured to the roadway and an upper end which is connected to said cable for transverse movement with said cable, whereby said anchor member and cable upon vehicle impact against said barrier wall and transverse movement thereof substantially returns said barrier wall to its original position.

9. A roadway barrier of claim 8 wherein said half sections are formed of precast metal reinforced concrete.

10. A roadway barrier of claim 1 wherein:

a plurality of transverse energy absorbing connections are spaced at selected intervals along the length of said columns to connect said columns of half sections to each other.

11. A roadway barrier of claim 10 wherein said transverse energy absorbing connections comprise bolts extending transversely through a pair of half sections in adjacent columns; and spring members are operatively connected to said bolts for absorbing energy upon impact of a moving vehicle against said wall and transverse movement of said half sections.

12. A roadway barrier of claim 1 wherein:

said longitudinal connecting member comprises a cable, and an impact absorbing means is operatively connected to said cable for partially absorbing impact energy of a moving vehicle against said barrier.

13. A roadway barrier of claim 12 wherein:

an anchor member for said cable has a lower end secured to the roadway and an upper end connected to said cable for transverse movement with said cable, whereby said anchor member and cable upon vehicle impact against said barrier and transverse movement thereof returns said barrier to its original position.

14. A roadway barrier for absorbing energy from a moving vehicle comprising:

a pair of longitudinally extending columns in side by side relation to each other with each column forming half of the barrier, each column including a plurality of elongate concrete half sections, placed end to end to each other, with the half sections of one column positioned in staggered relation to the half sections in the other column;

a plurality of transverse impact absorbing connections spaced at selected intervals along the length of said columns to connect said columns of half sections to each other in a transverse direction;

each of said elongate concrete half sections having a longitudinally extending passage extending between opposed ends of each half section and aligned longitudinally with similar passages in adjacent half sections;

a cable secured within aligned passages of at least two adjacent half sections in each of said columns for longitudinally connecting said adjacent half sections; and anchor means having a lower end secured to said roadway and an upper end connected to said cable, said anchor means for moving transversely with said cable and associated half sections.

15. A roadway barrier of claim 14 further comprising:

energy absorbing means operatively connected to said cable to absorb partially impact energy from a moving vehicle upon transverse movement of said cable and associated half sections resulting from said impact, said cable and impact energy absorbing means providing return of said associated half sections to their original position after partially absorbing impact energy.

16. A roadway barrier of claim 14 wherein:

a tubular liner forms said passages in said elongate concrete half sections and receives said cable therein.

17. A roadway barrier of claim 16 wherein:

a joint is defined between adjacent ends of said half sections; and wherein said anchor means includes an anchor member at selected joints which is coupled to said cable.

18. A roadway barrier system comprising:

a pair of upstanding modules positioned in separate columns in a back to back relation to each other at a predetermined unrestrained position on the roadway; each module including a plurality of elongate half sections in end to end relation with half sections in one module being staggered relative to half sections in the other module;

a cable for each module connected to the plurality of elongate half sections therein for securing said half sections to each other;

anchor means secured to the roadway and connected to said cable, said anchor means moving transversely with said cable and associated half sections upon impact of a moving vehicle against the half sections; and transverse connecting means to connect said modules in said separate columns to each other at selected intervals along the length of said modules.

19. A roadway barrier system as set forth in claim 18 wherein:

impact energy absorbing means are operatively connected to said cable to absorb partially an impact from a moving vehicle upon transverse movement of said modules from said unrestrained position on said roadway.

20. A roadway barrier as set forth in claim 18 wherein:

a joint is defined between adjacent ends of said half sections; and said anchor means includes an anchor member at selected joints connected to said cable.

21. A roadway barrier system as set forth in claim 18 wherein:

said half sections are formed of reinforced concrete and each of said half sections has an axial passage extending between opposed ends thereof and aligned axially with similar passages in adjacent half sections; and said cable for each module is received within aligned passages of associated half sections.

22. A method of installing a vehicle barrier on a roadway comprising:

aligning a plurality of elongate half sections in end to end relation with each half section having an axial passage therethrough aligned axially with similar passages in adjacent half sections;

inserting a connecting member within said aligned passages and anchoring the ends of said connecting member at the remote ends of said plurality of half sections to connect said half sections together for forming a module;

positioning a plurality of modules in two back to back columns on the roadway with the modules in one column lapping the modules in the other column; and connecting half sections of the back to back modules in said two columns to each other in a transverse direction to tie the two columns together to form said barrier.

23. The method of installing a vehicle barrier on a roadway as set forth in claim 22 further including the steps of:

positioning a cable within said aligned passages to form said connecting member; and anchoring the cable to the roadway at selected locations.

24. The method of installing a vehicle barrier wall on a roadway as set forth in claim 23 further including the steps of:

providing transversely aligned passages in selected back to back half sections of said columns;

inserting connecting members within said transversely aligned passages; and mounting resilient shock absorbing means between said connecting members and the associated half sections.

25. A method of installing a vehicle barrier wall on a roadway as set forth in claim 22 including the steps of:

forming said half sections of reinforced concrete; and forming each half section with a planar rear side for contacting a similar planar rear side of a half section in the adjacent column.

26. A method of installing a vehicle barrier wall on a roadway comprising:

aligning a plurality of elongate half sections in end to end relation with each half section having an axial passage therethrough aligned axially with similar passages in adjacent half sections and having a transverse passage therethrough aligned transversely with similar passages in back to back half sections;

inserting a cable within said aligned passages and anchoring the ends of said cable at the remote ends of said plurality of half sections to connect said half sections together for forming a module;

anchoring said cable to the roadway;

forming a plurality of modules with each module having a plurality of connected half sections;

positioning said plurality of modules in two back to back columns on the roadway with the modules in one column lapping the modules in the other columns, the back to back modules having transversely aligned openings in adjacent back to back half sections; and inserting transverse connecting members in said transversely aligned passages and securing said transverse connecting members to the connected half sections to connect said columns together to form said barrier wall.

27. A method of installing a vehicle barrier wall as set forth in claim 26 including the steps of:

mounting resilient shock absorbing means between said transverse connecting members and the associated half sections.

* * * * *